United States Patent [19]

Mayer et al.

[11] Patent Number: 4,719,002

[45] Date of Patent: Jan. 12, 1988

[54] SLURRY HYDROCONVERSION PROCESS

[75] Inventors: Francis X. Mayer; William E. Lewis, both of Baton Rouge, La.

[73] Assignee: Exxon Research and Engineering Company, Florham Park, N.J.

[21] Appl. No.: 854,308

[22] Filed: Apr. 21, 1986

[51] Int. Cl.[4] ..... C10G 69/00

[52] U.S. Cl. ..... 208/85; 208/108; 208/112; 208/216 R; 502/168; 502/211

[58] Field of Search ..... 208/108, 112, 204 H, 208/216 R, 89, 85; 502/170, 211

[56] References Cited

U.S. PATENT DOCUMENTS

| | | | |
|---|---|---|---|
| 3,825,488 | 7/1974 | Gatsis | 502/211 |
| 3,840,472 | 10/1974 | Colgan et al. | 502/211 |
| 4,077,867 | 3/1978 | Aldridge et al. | 208/10 |
| 4,111,787 | 9/1978 | Aldridge et al. | 208/10 |
| 4,226,742 | 10/1980 | Bearden, Jr. et al. | 502/170 |
| 4,244,839 | 1/1981 | Aldridge et al. | 502/170 |
| 4,417,972 | 11/1983 | Francis et al. | 502/22 |
| 4,444,907 | 4/1984 | Ohdan et al. | 502/211 |
| 4,522,702 | 6/1985 | Kukes et al. | 208/89 |
| 4,557,822 | 12/1985 | Bearden et al. | 208/108 |
| 4,567,156 | 1/1986 | Bearden et al. | 208/108 |
| 4,579,838 | 4/1986 | Bearden et al. | 208/108 |
| 4,585,751 | 4/1986 | Kukes et al. | 502/211 |

*Primary Examiner*—Andrew H. Metz
*Assistant Examiner*—Anthony McFarlane
*Attorney, Agent, or Firm*—Marthe L. Gibbons; Henry E. Naylor

[57] ABSTRACT

A slurry hydroconversion process is provided in which a catalyst precursor concentrate comprising an aqueous solution of phosphomolybdic acid and a heavy oil is contacted with hot hydrogen to vaporize the water from the concentrate. The resulting catalyst precursor concentrate is introduced into a hydrocarbonaceous chargestock and the resulting mixture is heated in the presence of added hydrogen to convert the phosphomolybdic acid to a solid molybdenum-containing catalyst. The resulting slurry is subjected to hydroconversion conditions.

9 Claims, 1 Drawing Figure

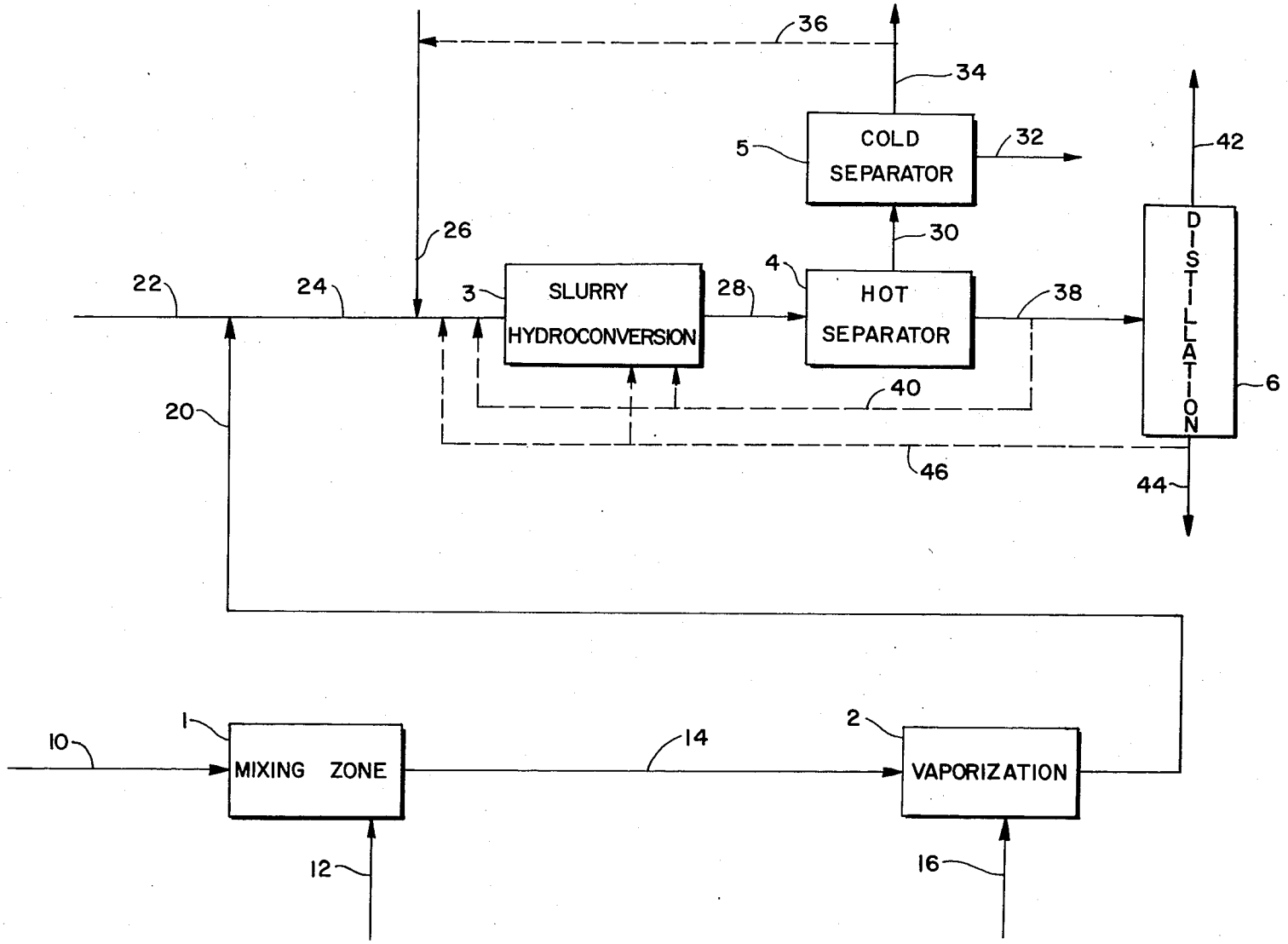
DISTILLATION
COLD SEPARATOR
HOT SEPARATOR
SLURRY HYDROCONVERSION
VAPORIZATION
MIXING ZONE
6
42
44
32
34
30
38
40
46
36
5
4
28
3
26
24
22
20
2
14
16
1
12
10

SLURRY HYDROCONVERSION PROCESS

BACKGROUND OF THE INVENTION

1. Field of the Invention

This invention relates to an improvement in a slurry hydroconversion process utilizing a metal-containing catalyst prepared from a catalyst precursor dispersed in a hydrocarbon.

2. Description of Information Disclosures

Slurry hydroconversion processes utilizing a catalyst prepared in a hydrocarbon oil from thermally decomposable or oil soluble metal compound precursors are known. See, for example, U.S. Pat. Nos. 4,226,742; 4,244,839 and 4,117,787.

It is also known to use such catalyst in hydroconversion processes (e.g., coal liquefaction) in which coal particles are slurried in a hydrocarbonaceous material. See, for example, U.S. Pat. No. 4,077,867.

The term "hydroconversion" with reference is a hydrocarbonaceous oil is used herein to designate a catalytic process conducted in the presence of hydrogen in which at least a portion of the heavy constituents of the oil is converted to lower boiling hydrocarbon products while it may simultaneously reduce the concentration of nitrogenous compounds, sulfur compounds and metallic constituents of the oil.

All boiling points referred to herein are atmospheric pressure equivalent boiling points unless otherwise specified.

It has now been found that a specified method of introducing the catalyst precursor into the hydrocarbonaceous feed will produce advantages that will become apparent in the ensuing description.

SUMMARY OF THE INVENTION

In accordance with the invention, there is provided a slurry hydroconversion process which comprises the steps of: (a) forming a mixture of a heavy hydrocarbonaceous oil and an aqueous solution of phosphomolybdic acid in an amount to provide in said mixture from about 0.2 to 2 wt.% molybdenum, calculated as elemental metal, based on said hydrocarbonaceous oil to produce a catalyst precursor concentrate; (b) contacting said catalyst precursor concentrate with a hot hydrogen-containing gas to vaporize water from said catalyst precursor concentrate; (c) introducing at least a portion of the catalyst precursor concentrate resulting from step (b) into a hydrocarbonaceous chargestock; (d) heating the mixture resulting from step (c) in the presence of an added hydrogen-containing gas at conditions to convert said phosphomolybdic acid to a solid molybdenum-containing catalyst; and (e) subjecting the resulting slurry comprising said hydrocarbonaceous chargestock and said solid molybdenum-containing catalyst to hydroconversion conditions in the presence of a hydrogen-containing gas to produce a hydroconverted oil product.

BRIEF DESCRIPTION OF THE DRAWING

The FIGURE is a schematic flow plan of one embodiment of the invention.

DESCRIPTION OF THE PREFERRED EMBODIMENT

Referring to the FIGURE, a heavy hydrocarbonaceous oil is introduced by line 10 into mixing zone 1. Suitable heavy hydrocarbonaceous oils for introducing into mixing zone 1 include hydrocarbonaceous oils comprising constituents boiling above 1050° F., preferably having at least 10 wt.% constituents boiling above 1050° F., such as crude oils, atmospheric residuum boiling above 650° F., vacuum residuum boiling above 1050° F. and mixtures thereof. The hydrocarbonaceous oil may be a blend, for example, of vacuum residuum and from about 10 to 50 weight percent virgin gas oil. Preferably, the heavy hydrocarbonaceous oil is a sulfur-containing oil comprising at least about 1.0 weight percent, preferably from 1.0 to 3.0 weight percent sulfur, calculated as elemental sulfur. The sulfur in the oil will be derived typically from organic sulfur compounds that are present in the oil. If desired, an additional source of sulfur may be added to the oil such as additional organic sulfur compounds or elemental sulfur. More preferably, the hydrocarbonaceous oil has an initial boiling point above at least 650° F. and comprises asphaltenes and/or resins. The hydrocarbonaceous oil carried by line 10 may be derived from any source, such as petroleum, tar sand oil, shale oil, liquids derived from coal liquefaction processes, and mixtures thereof. Generally, these oils have a Conradson carbon content ranging from about 5 to about 50 weight percent (as to Conradson carbon, see ASTM test D189-65). An aqueous solution of phosphomolybdic acid (catalyst precursor) is introduced into mixing zone 1 by line 12. A sufficient amount of the aqueous phosphomolybdic acid solution is introduced into mixing zone 1 to provide from about 0.2 to 2, preferably from about 0.2 to 1, more preferably from about 0.3 to about 1 wt.% molybdenum derived from the phosphomolybdic acid, calculated as elemental metal based on the hydrocarbonaceous oil. The resulting mixture will herein be designated "catalyst precursor concentrate". The aqueous catalyst precursor concentrate is removed from mixing zone 1 and passed to a water vaporization zone 2, where the catalyst precursor concentrate is heated to a temperature sufficient to vaporize substantially all the water that may be present in the concentrate by introducing a hot hydrogen-containing gas by line 16 into zone 2. It is not necessary to conduct the hot hydrogen contacting in a separate vessel or zone. In a preferred method, the hot hydrogen is introduced directly into line 14. The vaporized $H_2O$ (i.e., steam) remains in the gaseous phase. The hydrogen-containing gas may be a recycle gas derived from the process. Suitable temperature of the hydrogen-containing gas of line 16 include a temperature ranging from about 100° F. to about 700° F. At least a portion of the catalyst precursor concentrate from which the liquid water has been removed is passed by line 20 into a hydrocarbonaceous chargestock carried in line 22. If desired, the vapor phase $H_2O$ that was produced by conversion of liquid water to steam in zone 2 may be passed by line 20 with the catalyst precursor concentrate into line 22. Alternatively, the vapor phase $H_2O$ may be removed from zone 2 prior to passing the catalyst precursor concentrate into line 22. The hydrocarbonaceous chargestock may have the same or a different boiling point range from the boiling point range of the hydrocarbonaceous oil of line 10. Suitable hydrocarbonaceous chargestocks include crude oils, mixtures of hydrocarbons boiling above 430° F., preferably above 650° F., for example, gas oils, asphalt, vacuum residua, atmospheric residua, once-through coker bottoms and mixtures thereof. These oils may have a high content of metallic contaminants (nickel, iron, vanadium) usually present in the form of organometallic compounds, e.g., metalloporphyrins, a high content of sulfur compounds, particularly organic sulfur compounds, and a high content of nitrogenous compounds. The hydrocarbonaceous oil may be derived from any source, such a petroleum, shale oil, tar sand oil, oils derived from coal liquefaction processes, including coal liquefaction bottoms and mixtures thereof. Preferably, the hydrocarbonaceous oils have at least 10 wt.% materials boiling above 1050° F., more preferably, the hydrocarbonaceous oils have a Conradson carbon content ranging from about 5 to about 50 wt.%. The catalyst precursor concentrate from which the water has been vaporized is added to the hydrocarbonaceous chargestock in an amount sufficient to provide from about 10 to about 2000 wppm Mo, preferably from about 50 to about 1000 wppm Mo, calculated as elemental metal, based on the total mixture (concentrate plus hydrocarbonaceous chargestock plus optional recycle product). A hydrogen-containing gas is introduced by line 26 into the resulting mixture carried in line 24 at a temperature sufficient to increase the temperature of the catalyst precursor concentrate and hydrocarbonaceous chargestock. Suitable temperatures of the hydrogen introduced into line 24 may range from about 700° F. to about 1050° F. Catalyst preforming begins upon the contacting of the hot hydrogen of line 26 and the mixture carried in line 24. The process can be enhanced by use of in-line mixers. The temperature and conditions of mixing the hot hydrogen of line 26 and the mixture of line 24 may be such as to convert the phosphomolybdic acid to the solid molybdenum-containing catalyst. Alternatively, the phosphomolybdic acid may be converted to the solid molybdenum-containing catalyst in the slurry hydroconversion zone. The resulting mixture of hydrogen-containing gas and hydrocarbonaceous chargestock comprising the catalyst precursor and/or the solid molybdenum-containing catalyst is passed by line 24 into slurry hydroconversion zone 3.

Suitable hydroconversion operating conditions are summarized in Table I.

TABLE I

| Conditions | Broad Range | Preferred Range |
|---|---|---|
| Temp., °F. | 800–900 | 820–870 |
| $H_2$ Partial Pressure, psig | 100–5000 | 300–2500 |

In hydroconversion zone 3, at least a portion of the hydrocarbonaceous chargestock is converted to lower boiling hydrocarbon products. The hydroconversion reaction zone effluent is removed by line 28 and introduced into hot separator 4. The overhead of the hot separator is passed by line 30 into cold separator 5. A light normally liquid hydrocarbon stream is removed from cold separator 5 by line 32. A gas is removed by line 34. A portion of this gas may be recycled to the hydroconversion zone 3 by line 36. Intermediate liquid hydrocarbons, heavy hydrocarbons and solids (i.e., hot separator bottoms) are removed by line 38 from hot separator 4 and introduced into distillation zone 6. Preferably, a portion of the hot separator bottoms is recycled to slurry hydroconversion zone 3 by line 40 directly or indirectly. If desired, solids may be removed from stream 38 by conventional means prior to introducing the stream to distillation zone 6. This also gives the option to add feed directly to the product distillation zone (e.g., vacuum pipestill). An intermediate liquid hydrocarbon stream is removed from distillation zone 6 by line 42. A heavy liquid hydrocarbonaceous stream which may comprise solids (if the solids had not been removed previously) is removed from distillation zone 6 by line 44. If desired, a portion of this stream may be recycled by line 46 to the hydroconversion zone directly or indirectly, for example, by introducing it into line 22 or 24 with or without intermediate removal of solids. Furthermore, if desired, at least a portion of the solids removed from any of the hydroconversion effluent streams may be recycled to the hydroconversion zone directly or indirectly.

In the process of the present invention, there is no need to add gaseous hydrogen sulfide at any stage of the catalyst preparation, that is, mixing zone 1, zone 2, lines 14, 20, 22 and 24. The omission of gaseous hydrogen sulfide simplifies the process and eliminates equipment that would be required to handle the gaseous $H_2S$. Thus, the process may be conducted in the substantial absence of extraneous added $H_2S$. Furthermore, when the catalyst precursor concentrate is dried in the line, this process also eliminates the need for a separate water removal zone or vessel.

What is claimed is:

1. A slurry hydroconversion process for converting the heavy constituents of a hydrocarbonaceous oil to lower boiling products which comprises the steps of:

(a) forming a mixture of a heavy hydrocarbonaceous oil and an aqueous solution of phosphomolybdic acid in an amount to provide in said mixture from about 0.2 to 2 weight percent molybdenum, calculated as elemental metal, based on said hydrocarbonaceous oil to produce a catalyst precursor concentrate;

(b) contacting said catalyst precursor concentrate with a hot hydrogen-containing gas to vaporize water from said catalyst precursor concentrate;

(c) introducing at least a portion of the catalyst precursor concentrate resulting from step (b) into a hydrocarbonaceous chargestock;

(d) heating the mixture resulting from step (c) in the presence of an added hydrogen-containing gas at conditions to convert said phosphomolybdic acid to a solid molybdenum-containing catalyst; and (e) hydroconverting the resulting slurry comprising said hydrocarbonaceous chargestock and said solid molybdenum-containing catalyst at a temperature from about 800° to 900° F. and a hydrogen partial pressure ranging from about 100 psig to about 5000 psig, wherein at least a portion of the heavy constituents of the oil are converted to lower boiling products.

2. The process of claim 1 wherein said hydroconverted oil product is separated into fractions including a heavy bottoms fraction and wherein at least a portion of said bottoms fraction is recycled to said hydrocarbonaceous chargestock.

3. The process of claim 1 wherein said hot hydrogen-containing gas of step (b) has a temperature ranging from about 100° F. to about 700° F., and wherein said hydrogen-containing gas of step (d) has a temperature ranging from about 700° F. to about 1050° F.

4. The process of claim 1 wherein said hydrocarbonaceous oil of step (a) and said hydrocarbonaceous chargestock have the same boiling point.

5. The process of claim 1 wherein said hydrocarbonaceous oil of step (a) and said hydrocarbonaceous chargestock have different boiling point ranges.

6. The process of claim 1 wherein said molybdenum is present in said mixture of step (a) in an amount ranging from about 0.2 to 1 weight percent.

7. The process of claim 1 wherein said hydrocarbonaceous oil of step (a) comprises at least about 10 weight percent constituents boiling above 1050° F.

8. The process of claim 1 wherein in step (c) said catalyst precursor concentrate resulting from step (b) is introduced into said hydrocarbonaceous chargestock in an amount such as to provide from about 10 to about 2000 wppm of said molybdenum, calculated as elemental metal, based on said hydrocarbonaceous chargestock.

9. The process of claim 1 wherein said process is conducted in the absence of added hydrogen sulfide.

* * * * *